United States Patent [19]

Nakano et al.

[11] Patent Number: 4,752,755

[45] Date of Patent: Jun. 21, 1988

[54] CIRCUIT BREAKER

[75] Inventors: Shozo Nakano; Hideo Hayashi; Iwao Takamatsu, all of Kanagawa, Japan

[73] Assignee: Fuji Electric Co., Ltd., Kanagawa, Japan

[21] Appl. No.: 19,425

[22] Filed: Feb. 26, 1987

[30] Foreign Application Priority Data

Mar. 5, 1986 [JP] Japan ..... 61-47517

[51] Int. Cl.[4] ..... H01H 9/02; H01H 13/04

[52] U.S. Cl. ..... 335/202; 335/6; 335/172

[58] Field of Search ..... 335/202, 172, 6, 36, 335/174, 8, 9, 10, 42, 85, 83

[56] References Cited

U.S. PATENT DOCUMENTS 4,100,517 7/1978 Rodolfi ..... 335/132

*Primary Examiner*—E. A. Goldberg
*Assistant Examiner*—Lincoln Donovan
*Attorney, Agent, or Firm*—Finnegan, Henderson, Farabow, Garrett & Dunner

[57] ABSTRACT

A circuit breaker has an insulated casing including an upper casing portion and a lower casing portion. A switching mechanism is attached to a frame which is seated in a positioning recess portion of the lower casing portion. The frame and switching mechanism are captured by extending support arms of the lower casing portion and are fixedly secured thereto to permit operation of the switching mechanism prior to final assembly of the upper and lower casing portions.

6 Claims, 7 Drawing Sheets

CIRCUIT BREAKER

BACKGROUND OF THE INVENTION

The present invention generally relates to circuit breakers and more particularly, to an electromagnetic circuit breaker having a switching mechanism mounted in an insulating casing.

Circuit breakers are widely used in industrial, residential, and commercial applications to provide protection against damage due to overcurrent conditions in an electrical circuit. The electrical circuit through the circuit breaker can be established and interrupted by manual operation of a switching mechanism. In addition, the electrical circuit through the current breaker is automatically interrupted by an electromagnetic trip mechanism actuated by an overcurrent condition through the circuit breaker.

A conventional circuit breaker 20 of the type described above is shown in FIG. 1 in cross section. The circuit breaker 20 includes a casing 22 having separately formed left and right casing portions 24 and 26. A frame 28 supports therein a switching mechanism 30 which is connected to an operation handle 32 and is held at one side by frame guides 34 and 36, respectively provided at the upper and lower portions of the left casing portion 26. With the frame 28 in this position, the right casing portion 26 is assembled on the left casing portion 24 so that the frame 28 is held at its other side by frame guides 38 and 40, respectively provided at the upper and lower portions of the right casing portion 26. The left and right casing portions 24 and 26 are secured to each other by means of a rivet 42.

The structure of FIG. 1 has a disadvantage in that it is impossible to test the switching performance of the switching mechanism 30 by operating the operation handle 32 before the switching mechanism 30 has been completely assembled into the casing portions 24 and 26 since both casing portion 24 and 26 are required to support the frame 28 and the switch mechanism 30. This results in quality control problems.

FIG. 2 shows another example of a conventional circuit breaker having a casing structure which is different from the example of FIG. 1 in that a support 44 is used instead of the frame 28 of FIG. 12. A switching mechanism 30 is incorporated directly into a left casing portion 24, and then held by the support 44 from the right side in the drawing. Thereafter, a right casing portion 26 is put on the left casing portion 24, and then tightly connected with the latter by a rivet 42. As is the case with the structure of FIG. 1, the switching performance of the structure of FIG. 2 cannot be confirmed before the structure has been completely assembled as a circuit breaker, since the switching mechanism 30 is not completely supported until assembly is completed.

FIG. 3 shows an example of a conventional circuit breaker in which the casing is constituted by separately formed upper and lower casing portions 46 and 48. A switching mechanism 30 and a frame 28 are fixedly attached to the lower casing portion 48 by screws 50. The upper casing portion 46 is then mounted on the lower casing portion 48 and tightly connected with the latter by a rivet 42. This structure, however, is high in cost due to the number and shape of parts thereof, and is bulky due to excessive width.

FIG. 4 shows a further example of a conventional circuit breaker in which the casing is constituted by separately formed upper and lower casing portions 46 and 48 similar to the previous example in FIG. 3. A frame 28 into which a switching mechanism portion 30 has been assembled is inserted into the lower casing portion 48 and disposed in position. Then the upper casing portion 46 is attached to the lower casing portion such that engagement protrusions 52 are made to engage with fixing holes 54 of the upper casing portion 46. Switching mechanism 30 is thus captured and securely positioned by between the upper and lower casing portions 46 and 48. Similar to the examples of FIGS. 1 and 2, the structure of this example has a disadvantage in that the switching performance cannot be checked prior to assembly of the casing portions.

SUMMARY OF THE INVENTION

It is therefore an object of the present invention to eliminate the drawbacks in structure of conventional circuit breakers.

It is another object of the present invention to provide a circuit breaker having a compact structure.

It is a further object of the present invention to provide a circuit breaker having a structure in which assembly of parts can be easily and securely achieved.

It is a still further object of the present invention to provide a circuit breaker having a structure in which quality assurance functions such as operation tests, load tests, adjustments, and the like can be performed before assembly of the circuit breaker has been completed, that is, during the step of incorporating the switching mechanism into the casing.

In order to achieve the objects described above, according to the present invention, there is provided a circuit breaker for protecting an electrical circuit. The circuit breaker comprises a casing of insulating material including an upper casing portion and a separately formed lower casing portion covered by the upper casing portion. The upper casing portion has an upper surface. The lower casing portion comprises a bottom surface parallel to the upper surface and has two sides, a positioning recess portion between the sides, and a pair of oppositely facing support arms each extending from one of the sides of said bottom surface. The circuit breaker also comprises means for securing the upper casing portion to the lower casing portion and separable contacts mounted within the casing and operable between closed and open positions for respectively establishing and interrupting the electrical circuit, and a pair of terminals mounted on the casing portion and adapted for connection to the electrical circuit. The circuit breaker also comprises a frame mounted in the casing and having a pair of side surfaces and a mounting portion between the side surfaces, the mounting portion being seated in the positioning recess portion and the frame being captured in the lower casing portion by the support arms, a switching mechanism attached to the frame and operable when actuated to operate the contacts between closed and open positions, an operating handle coupled to the switching mechanism for actuating the switching mechanism, the handle extending through said casing upper surface, and and an electromagnetic trip unit mounted in the casing and coupled to the terminals for automatically actuating the switching mechanism to open the contacts upon overcurrent conditions.

Other objects, features, and advantages of the invention will be apparent from the following description taken in connection with the accompanying drawings.

DESCRIPTION OF THE PREFERRED EMBODIMENTS

Figure 1:
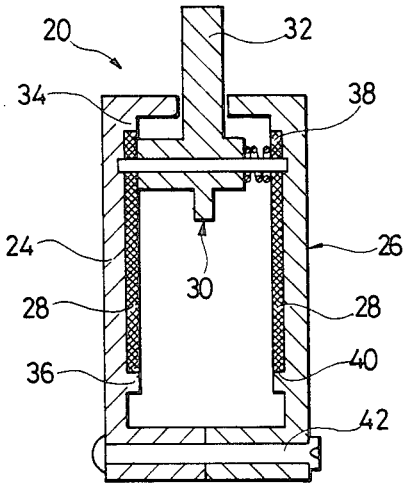
FIG. 1 PRIOR ART
FIGS. 1 through 4 are front sectional views of prior art circuit breakers.
Figure 2:
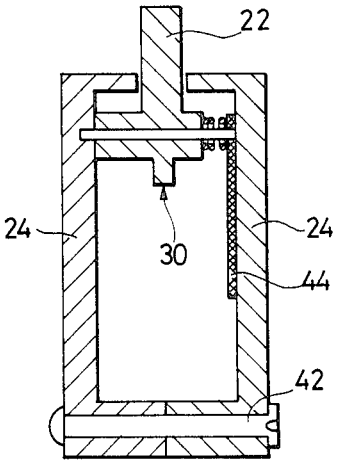
FIG. 2 PRIOR ART
Figure 3:
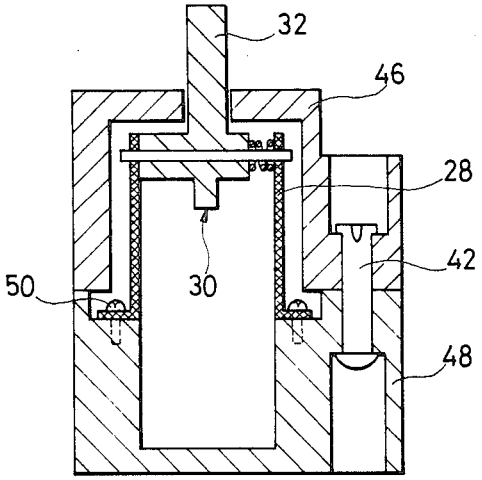
FIG. 3 PRIOR ART
Figure 4:
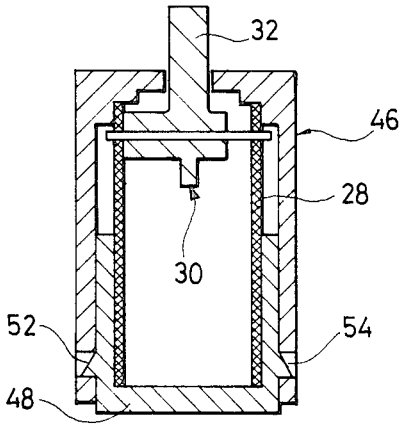
FIG. 4 PRIOR ART
Figure 5:
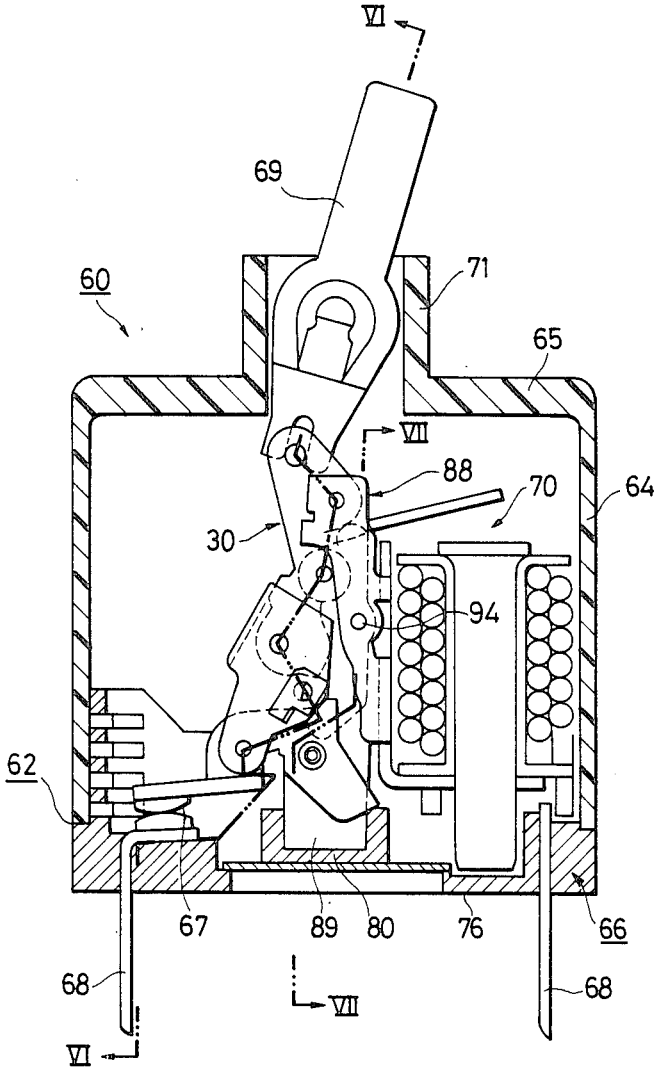
FIG. 5 a front sectional view of a circuit breaker constituting a first embodiment of the present invention.
Figure 6:
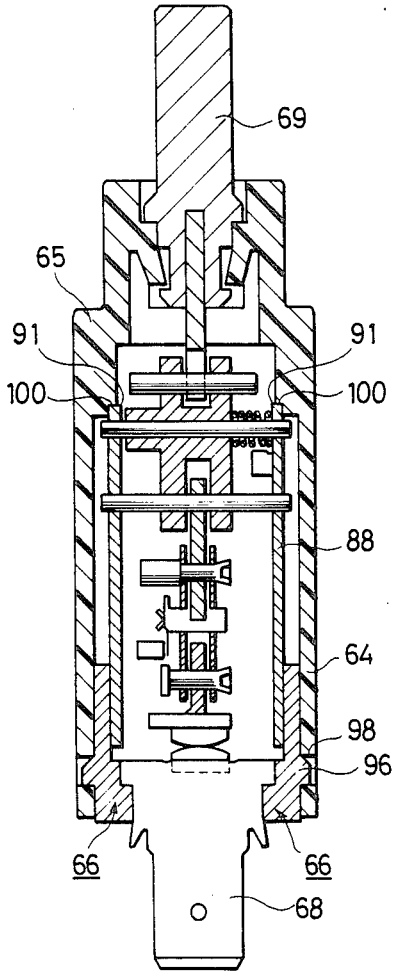
FIGS. 6 and 7 are side sectional views of the circuit breaker of FIG. 5 taken along the lines VI—VI and VII—VII, respectively.

Referring to the drawings, preferred embodiments of the present invention will now be described.

FIGS. 5 through 10 show a first embodiment of circuit breaker 60 according to the present invention. The circuit breaker 60 includes a casing 62 of molded insulating material having an upper casing portion 64 and a lower casing portion 66. Upper casing portion 64 includes an upper surface 65.

Figure 7:
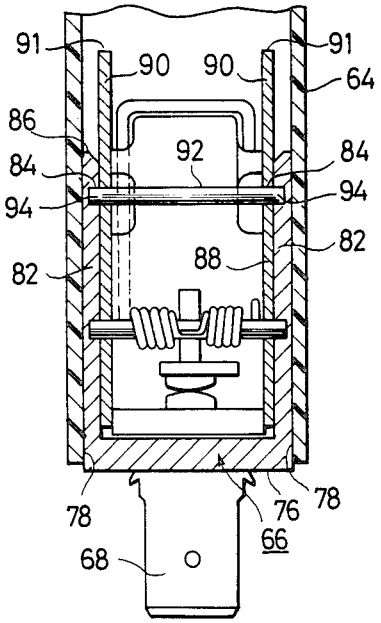
Figure 8:
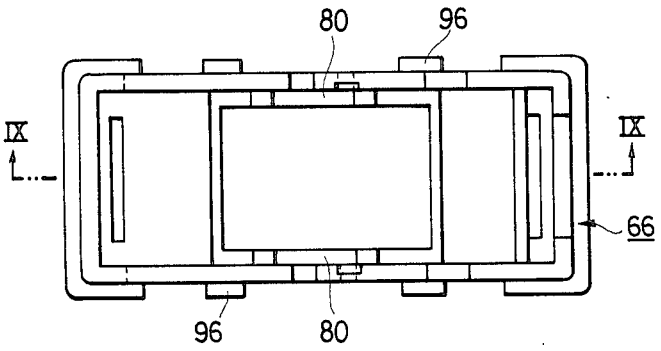
FIG. 8 is a plan view of a lower casing portion of the circuit breaker of FIGS. 5–7.
Figure 9:
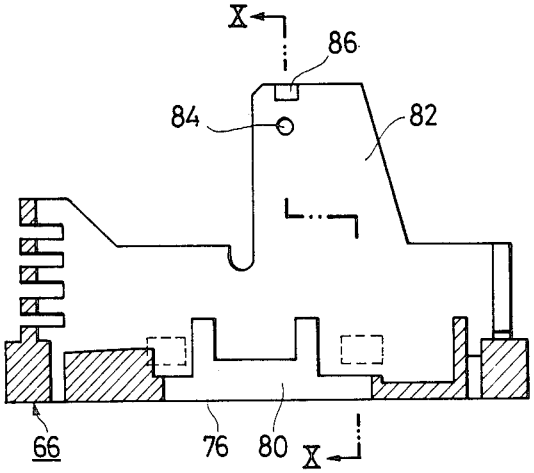
FIG. 9 is a front sectional view of the lower casing portion of FIG. 8, taken along the line IX—IX.
Figure 10:
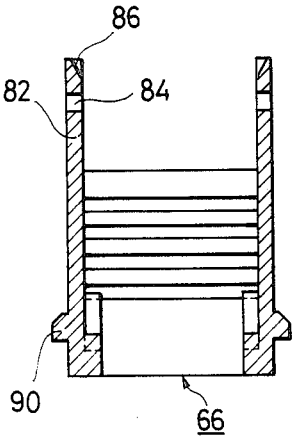
FIG. 10 is a side sectional view of the lower casing portion of FIG. 9, taken along the line X—X.
Figure 11:
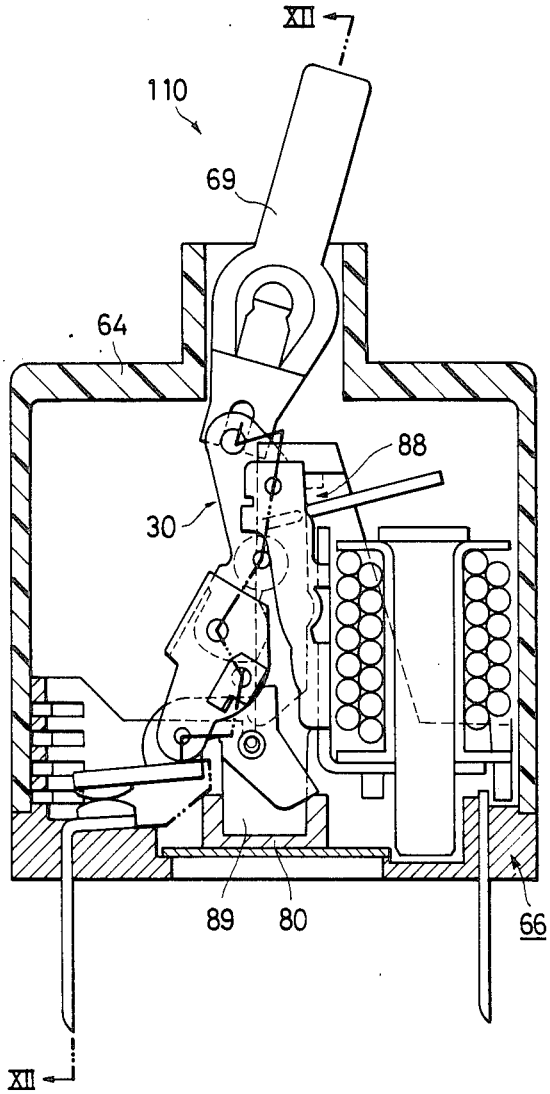
FIG. 11 is a front sectional view of a circuit breaker constituting a second embodiment of the present invention.
Figure 12:
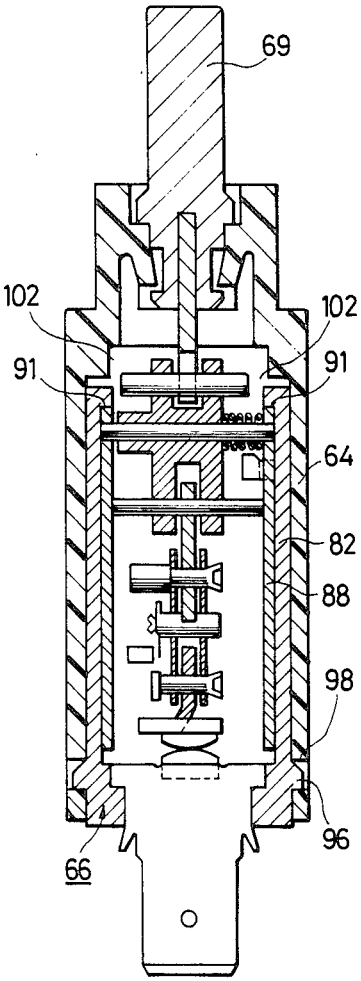
FIG. 12 is a side sectional view of the circuit breaker of FIG. 11, taken along the line XII—XII.
Figure 13:
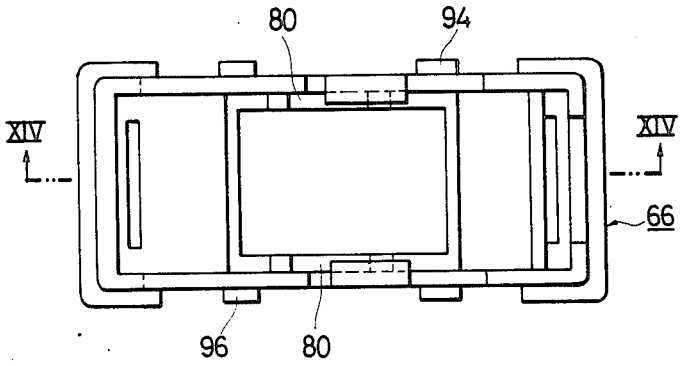
FIG. 13 is a plan view of the lower casing portion of the circuit breaker of FIGS. 11 and 12.
Figure 14:
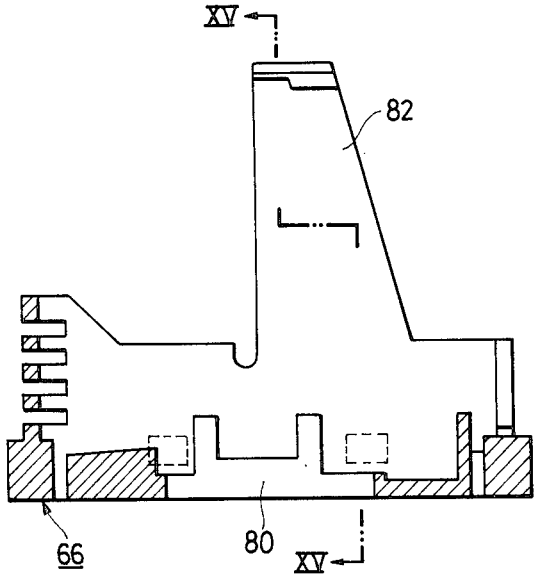
FIG. 14 is a front sectional view of the lower casing portion of FIG. 13, taken along the line XIV—XIV.
Figure 15:
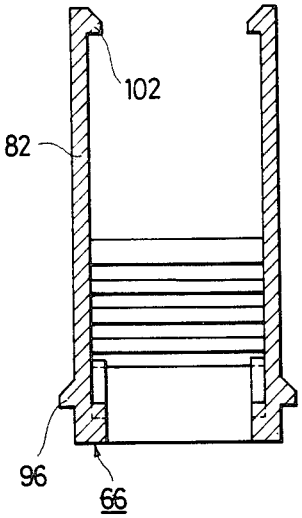
FIG. 15 is a side sectional view of the lower casing portion of FIG. 14 , taken along the line XV—XV.

Lower casing portion 66 has a bottom surface 76 (shown more completely in FIG. 7) parallel to upper surface 65 and having two sides 78 (see FIG. 7). A positioning recess portion 80 (shown more completely in FIG. 8) is located in bottom surface 76. Lower casing portion 66 also has a pair of oppositely facing support arms 82 each extending from one of the sides 78. Each support arm 82 includes a receiving aperture 84 (FIG. 9) and a chamfered portion 86 at its end.

Circuit breaker 60 also includes a pair of separable contacts 67 connected in series with a pair of terminals 68 mounted in bottom surface 76. Terminals 68 are adapted for series connection to an electrical circuit to be protected by circuit breaker 60. Contacts 67 are mechanically coupled to a switching mechanism 30 which is operable when actuated by a handle 69 to operate contacts 67 between closed and open positions to respectively establish and interrupt the electrical circuit being protected.

Circuit breaker 60 also includes an electromagnetic trip unit 70 coupled to contacts 67. Trip unit 70 operates in a wellknown manner to cause switching mechanism 30 to automatically open contacts 67 upon overcurrent conditions through the electrical circuit being protected.

The switching mechanism 30 is inserted into a metal frame 88 and movably attached to opposite side surfaces 90 (FIG. 7) of the frame 88 through a guide pin 92 (FIG. 7). Frame 88 includes a mounting portion 89. With the switching mechanism 30 attached, the frame 88 is inserted into the lower casing portion 66 in such a manner that opposite ends 94 (FIG. 7) of the guide pin 92, respectively projecting outward from the opposite side surfaces 90 of the frame 88, are positioned on the chamfered portions 86 of the support arms 82 of the lower casing portion 66. The frame 88 is pushed down against the chamfered surfaces 86 to widen the distance between the arms 82 so as to permit the opposite ends 94 of the guide pin 92 projecting from the frame 88 to slide down arms 82 and snap into the receiving apertures 84. Mounting portion 89 is simultaneously seated into the positioning recess portion 80. The frame 88 and the switching mechanism 30 are thus captured in the lower casing portion 66 by the support arms 82, and are thus securely mounted in lower casing portion 66 without requiring the presence of upper casing portion 64. In this condition, an operation test, an adjusting operation, and the like, can be performed by operating operation handle 69 to actuate switching mechanism 30 and contacts 67, even if the upper casing portion 64 is not attached.

For final assembly, upper casing portion 64 is slided over the lower casing portion 66, such that handle 69 extends through a collared aperture 71 in upper surface 65. The invention includes means for securing upper casing portion 64 to lower casing portion 66. As embodied herein, the securing means comprises engaging projections 96 (FIG. 6) provided at the lower portion of the lower casing portion 66 which are fitted into corresponding square engagement holes 98 provided at the lower part of the upper casing portion 64. After the upper casing portion 64 is attached, the upper end portions 91 (FIG. 6) of the frame 88, at the opposite end of frame 88 from mounting portion 89, are pressed by jaw portions 100 (FIG. 6) of the upper casing portion 10, so that the connection between the frame 88 and the lower casing portion 66 becomes much more reliable.

FIGS. 11 through 15 show a circuit breaker 110 which constitutes another embodiment of the circuit breaker according to the present invention. Elements of the embodiment of FIGS. 11–15 which are identical in function to the elements of embodiment of FIGS. 5–10 will be identified by identical reference characters. In the embodiment of FIGS. 11–15 a guide pin is not used to attach a frame 88 and a switching mechanism 30 to a lower casing portion 66. Instead, mounting portion 89 of the frame 88 is inserted into the positioning recess position 80 of the lower casing portion 66 and extending jaw projection 102, provided at the respective upper portions of support arms 82 of the lower casing portion 66, press the opposite upper end portions 91 of the frame 88 to thereby capture and fixedly secure frame 88 to the lower casing portion 66.

At this step of assembly, where the upper casing portion 64 is not yet assembled with the lower casing portion 66, an operation test, an adjusting operation, and the like, can be performed by operating an operation handle 69 to actuate switching mechanism 30 and contacts 67. The final assembly of the upper casing portion 64 with the lower casing portion 66 is similar to the previous embodiment.

According to the present invention, a circuit breaker provides a structure in which a switching mechanism is inserted into and movably attached onto a frame, and the subassembly of frame and switching mechanism is inserted into and fixedly secured to a first casing portion, thus providing a compact, easily assembled structure. The structure permits performance of quality assurance functions such as operation tests, load tests, and adjusting operations prior to final assembly of a second casing portion, resulting in reductions in defective products, fewer assembly steps, and an increase in miniaturization of the product.

What is claimed is:

1. A circuit breaker for protecting an electrical circuit, said circuit breaker comprising:

a casing of insulating material including an upper casing portion and a separately formed lower casing portion covered by said upper casing portion, said upper casing portion having an upper surface with downwardly extending side surfaces depending from said upper surface to form a recess in said upper casing portion and said lower casing portion comprising a bottom surface parallel to said upper surface and having two sides, a positioning recess portion between said sides, and a pair of oppositely facing support arms each extending upwardly from one of said sides of said bottom surface and being adapted to fit into said upper casing recess means for securing said upper casing portion to said lower casing portion;

separable contacts mounted within said casing and operable between closed and open positions for respectively establishing and interrupting said electrical circuit;

a pair of temrinals electrically connected to said contacts and mounted on said casing, said terminals being adapted for connection to said electrical circuit;

a frame mounted in said casing and having a pair of side surfces and a mounting portion between said side surfaces, said mounting portion being seated in said positioning recess portion and said frame being captured in said lower casing portion by said support arms;

a switching mechanism attached to said frame and operable when actuated to operate said contacts between closed and open positions;

an operating handle coupled to said switching mechanism for actuating said switching mechanism, said handle extending through said casing upper surface; and an electromagnetic trip unit mounted in said casing and coupled to said terminals for automatically actuating said switching mechanism to open said contacts upon overcurrent conditions through said contacts.

2. A circuit breakers recited in claim 1 wherein said terminals are mounted on said bottom surface.

3. A circuit braker for protecting an electrical circuit, said circuit breaker comprising:

a casing of insulating material including an upper casing portion and a separately formed lower casing portion covered by said upper casing portion, said upper casing portion having an upper surface and said lower casing portion comprising a bottom surface parallel to said upper surface and having two sides, a positioning recess portion between said sides, and a pair of oppositely facing support arms each extending from one of said sides of said bottom surface;

means for securing said upper casing portion to said lower casing portion;

separable contacts mounted within said casing and operable between closed and open positions for respectively establishing and interupting said electrical circuit;

a pair of terminals electrically connected to said contacts and mounted on said casing, said terminals being adapted for connection to said electrical circuit;

a frame mounted in said casing and having a pair of side surfces and a mounting portion between said side surfaces, said mounting portion being seated in said positioning recess portion and said frame being captured in said lower casing portion by said support arms, said frame further comprising a mounting pin extending between said side surfaces and having a pair of ends extending exterior to said side surfaces, wherein said support arms each include a receiving aperture, and wherein said extending ends are seated in said receiving apertures to capture said frame to said lower casing position;

a switching mechanism attached to said frame and operable when actuated to operate said contacts between closed and open positions;

an operating handle coupled to said switching mechanism for actuating said switching mechanism, said handle extending through said casing upper surface; and an electromagnetic trip unit mounted in said casing and coupled to said terminals for automatically actuating said switching mechanism to open said contacts upon overcurrent conditions through said contacts.

4. A circuit breaker as recited in claim 3 wherein said support arms each include a chamfered surface at the ends thereof.

5. A circuit breaker as recited in claim 1 wherein said frame side surfaces each include an end portion located opposite said mounting portion and said support arms each include an extending jaw projection at the end of said arm opposite said bottom surface, said projections engaging said side surface end portions to capture said frame to said lower casing portion.

6. A circuit breaker as recited in claim 1 wherein said securing means comprises an engagement hole on one of said upper and lower casing portions and an engaging projection on the other of said upper and lower casing portions, said engaging projection extending into said engagement hole.

* * * * *